US008480421B2

(12) United States Patent
Yoshioka et al.

(10) Patent No.: US 8,480,421 B2
(45) Date of Patent: Jul. 9, 2013

(54) METHOD OF INTEGRALLY MOLDING CONNECTOR, AND OBJECT CONNECTOR

(75) Inventors: Nobuaki Yoshioka, Makinohara (JP); Ikuo Morita, Makinohara (JP)

(73) Assignee: Yazaki Corporation, Tokyo (JP)

( * ) Notice: Subject to any disclaimer, the term of this patent is extended or adjusted under 35 U.S.C. 154(b) by 96 days.

(21) Appl. No.: 13/263,365

(22) PCT Filed: Jun. 18, 2010

(86) PCT No.: PCT/JP2010/060394

§ 371 (c)(1),
(2), (4) Date: Oct. 7, 2011

(87) PCT Pub. No.: WO2011/001840

PCT Pub. Date: Jan. 6, 2011

(65) Prior Publication Data

US 2012/0040571 A1 Feb. 16, 2012

(30) Foreign Application Priority Data

Jun. 30, 2009 (JP) ..... 2009-154937

(51) Int. Cl.
*H01R 13/40* (2006.01)

(52) U.S. Cl.
USPC ..... 439/275; 439/587; 439/606

(58) Field of Classification Search
USPC ..... 439/271, 274, 275, 276, 278, 279, 439/281, 587, 606
See application file for complete search history.

(56) References Cited

U.S. PATENT DOCUMENTS

| | | | | |
|---|---|---|---|---|
| 6,482,021 | B2 * | 11/2002 | Hara et al. | 439/279 |
| 7,040,906 | B2 * | 5/2006 | Yamakawa et al. | 439/76.2 |
| 7,182,617 | B1 * | 2/2007 | Cairns et al. | 439/271 |
| 7,641,494 | B2 * | 1/2010 | Chen et al. | 439/275 |
| 7,959,464 | B2 * | 6/2011 | Mizutani et al. | 439/588 |
| 2002/0052143 | A1 * | 5/2002 | Hara et al. | 439/606 |

(Continued)

FOREIGN PATENT DOCUMENTS

| | | | |
|---|---|---|---|
| JP | 54-97894 | U | 7/1979 |
| JP | 2001-273946 | A | 10/2001 |

(Continued)

OTHER PUBLICATIONS

International Search Report (PCT/ISA/210) dated Aug. 3, 2010, for PCT/JP2010/060394.

(Continued)

*Primary Examiner* — James Harvey
(74) *Attorney, Agent, or Firm* — Sughrue Mion, PLLC

(57) ABSTRACT

There is provided a method of integrally molding a connector in which the number of components can be reduced, and productivity can be enhanced.

The method of integrally molding a connector according to the invention includes a first step of injection molding elastic resin 15 around a connection part 9 and an end part of a cover part 5 of an electric wire which is positioned adjacent to the connection part 9 thereby to bond the cover part 5 and the elastic resin 15 to each other, and a second step of injection molding resin 17 around the elastic resin 15 so as to compress the elastic resin 15 thereby to press-fit the elastic resin 15 to a terminal 11, and at the same time, to bond the elastic resin 15 and the resin 17 to each other.

3 Claims, 2 Drawing Sheets

U.S. PATENT DOCUMENTS

| | | | | |
|---|---|---|---|---|
| 2010/0075535 | A1* | 3/2010 | Mizutani et al. | 439/588 |
| 2012/0040571 | A1* | 2/2012 | Yoshioka et al. | 439/736 |
| 2012/0214359 | A1* | 8/2012 | Yamada | 439/874 |
| 2013/0017719 | A1* | 1/2013 | Tanaka et al. | 439/587 |

FOREIGN PATENT DOCUMENTS

| | | | |
|---|---|---|---|
| JP | 2002-134220 | A | 5/2002 |
| JP | 2008-177871 | A | 7/2008 |
| JP | 2008-269858 | A | 11/2008 |
| WO | 2008/130001 | A1 | 10/2008 |

OTHER PUBLICATIONS

Written Opinion (PCT/ISA/237) dated Aug. 3, 2010, for PCT/JP2010/060394.

* cited by examiner

METHOD OF INTEGRALLY MOLDING CONNECTOR, AND OBJECT CONNECTOR

TECHNICAL FIELD

The present invention relates to a method of integrally molding a connector having waterproofing performance, and the object connector.

BACKGROUND ART

As the connector having waterproofing performance, there has been conventionally known such a connector that an electric wire and a housing are integrally molded out of thermoplastic resin, and a joint part between the respective members is sealed with thermoplastic resin (Reference should be made to Patent Document 1, for example).

In the connector as described above, the waterproofing performance of the connector side depends on a shape of a counterpart member to be connected to the connector. In this connector, although the counterpart member side need not be sealed depending on type of oil-proofing or so, in some cases, there is such anxiety that oil or the like may run along the electric wire and spread, unless the connector side is sealed. In case where a sealing mechanism is required, it would be more efficient that sealing performance is provided on the connector side from the viewpoint of reduction of the number of components and downsizing.

In view of the above, there has been known a connector which is integrally molded by providing a primary resin forming member for integrally covering both a terminal and covering material for a cable, assembling a seal ring to a joint part between the primary resin forming member and the covering material, and then, providing a secondary resin forming member for covering the primary resin forming member, the covering material, and the seal ring (Reference should be made to Patent Document 2, for example).

Moreover, there has been also known a connector which is integrally molded by providing a heat insulating layer formed of synthetic resin for integrally covering a terminal metal fitting and a shield wire, applying hot melt to a tab of the terminal metal fitting, and then, providing a housing formed of synthetic resin for covering the heat insulating layer, the shield wire, and the hot melt (Reference should be made to Patent Document 3, for example).

PATENT DOCUMENTS

Patent Document 1: JP-A-2002-134220
Patent Document 2: JP-A-2008-269858
Patent Document 3: JP-A-2001-273946

However, in the connector in which the terminal is sealed with the resin as disclosed in Patent Documents 2 and 3, the terminal is generally formed of metal such as copper, aluminum, which is plated, and therefore, in case where the resin adhesive to metal is used, the resin also adheres to a metal mold when the resin is molded. In this case, mold releasing performance for removing the mold from the hardened resin is deteriorated, which incurs bad influences such as deterioration of productivity or change in shape, and mass production is difficult.

Moreover, in the connectors disclosed in Patent Documents 2 and 3, although intrusion of water from the electric wire and the terminal can be restrained, it is necessary to provide the seal ring or the hot melt, in addition to the primary resin forming member or the heat insulating layer. Therefore, the number of components and assembling steps are increased.

In view of the above, an object of the invention is to provide a method of integrally molding a connector in which the number of components can be reduced and productivity can be enhanced, and to provide the object connector.

SUMMARY OF THE INVENTION

According to the invention, there is provided a method of integrally molding a connector for integrally molding an electric wire having a core part covered with a cover part, a terminal having a connection part connected to the core part of the electric wire which is exposed by peeling off the cover part, and a covering member provided around the connection part, the method comprising a first step of injection molding elastic resin around the connection part and an end part of the cover part which is positioned adjacent to the connection part thereby to bond the cover part and the elastic resin to each other, and a second step of injection molding resin around the elastic resin so as to compress the elastic resin, and at the same time, bonding the elastic resin and the resin to each other.

Moreover, in the method of integrally molding a connector according to the invention, in the second step, the resin is injection molded around a region positioned adjacent to the connection part, out of the elastic resin, while a region positioned adjacent to the cover part, out of the elastic resin, is exposed.

According to the invention, there is further provided a connector comprising an electric wire having a core part covered with a cover part, a terminal having a connection part connected to the core part of the electric wire which is exposed by peeling off the cover part, and a covering member provided around the connection part, all of which are integrally molded, wherein the covering member includes elastic resin which is provided around the connection part and an end part of the cover part positioned adjacent to the connection part, the elastic resin being bonded to the cover part, and at the same time, press-fitted to the terminal, and resin which is provided around the elastic resin so as to compress the elastic resin, and bonded to the elastic resin.

Advantage of the Invention

In the method of integrally molding a connector according to the invention, the elastic resin is bonded to the cover part, and the elastic resin is bonded to the resin and press-fitted to the terminal. Therefore, the elastic resin and the resin do not adhere to metal molds which are used in the first and second steps, and mold releasing performance can be enhanced. In this manner, it is possible to restrain bad influences such as deterioration of productivity, change in shape, and mass production can be achieved.

Moreover, in the second step, the resin is injection molded around the elastic resin so as to compress the elastic resin, and the elastic resin is press-fitted to the terminal thereby to seal a gap between the elastic resin and the terminal. As the results, there is no necessity of using other members for waterproofing the connector, and the number of components and assembling steps can be reduced.

Accordingly, it is possible to reduce the number of the components, and to enhance productivity.

Moreover, in the method of integrally molding a connector according to the invention, in the second step, the resin is injection molded around the region positioned adjacent to the connection part, out of the elastic resin which has been injection molded around the connection part, and the region positioned adjacent to the cover part, out of the elastic resin, is exposed. Therefore, a drawing part of the electric wire can be made flexible, while maintaining rigidity of the drawing part of the electric wire, and freeness in arranging the connector can be enhanced.

MODE FOR CARRYING OUT THE INVENTION

Figure 1:
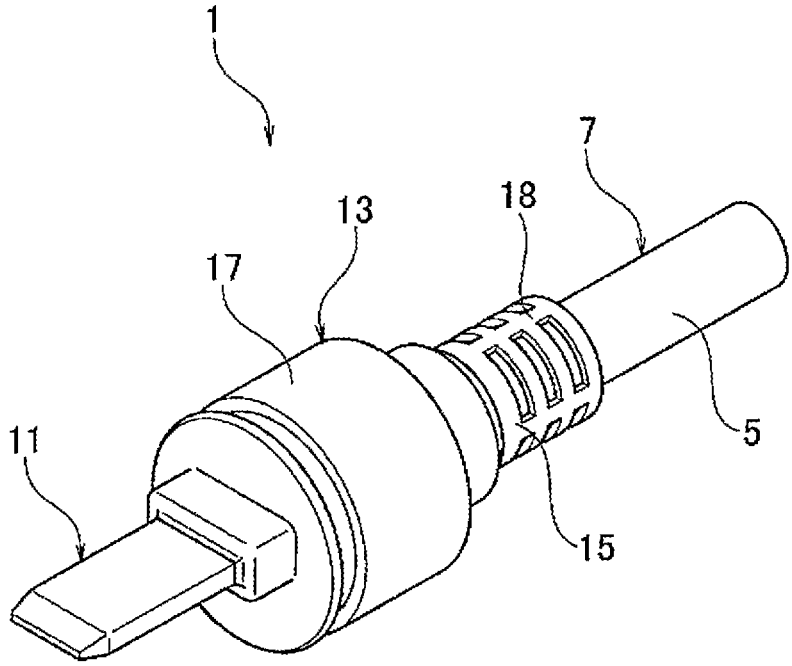
FIG. 1 is a perspective view of a connector in an embodiment according to the invention.
Figure 2:
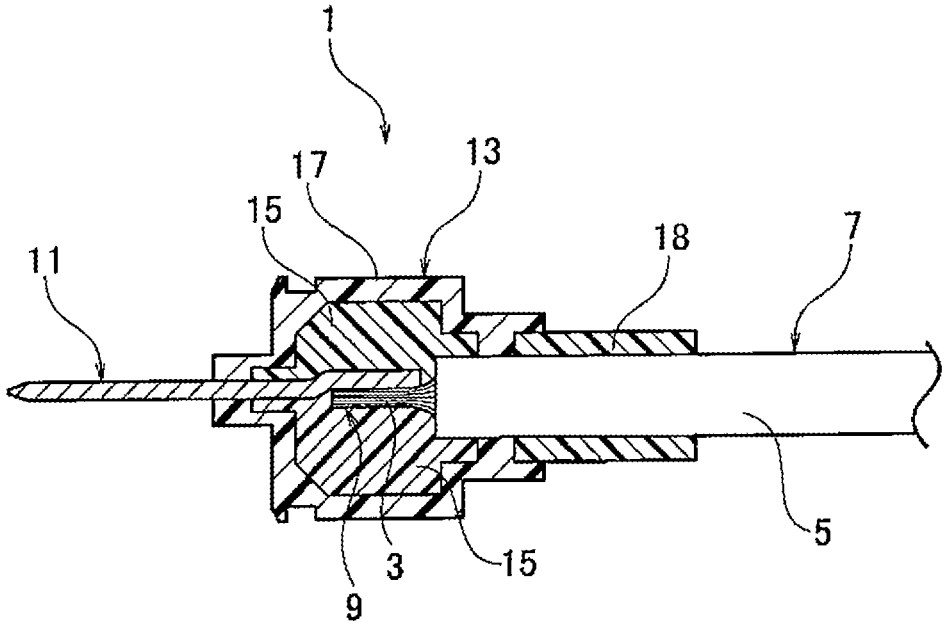
FIG. 2 is a sectional view of the connector in FIG. 1.
Figure 3:
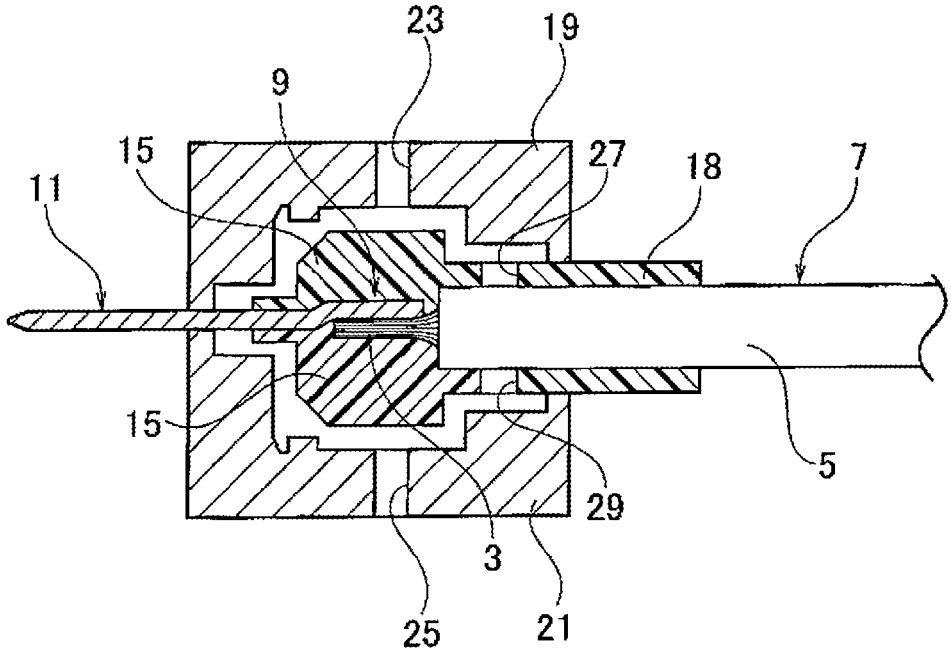
FIG. 3 is a view showing a process for integrally molding the connector in the embodiment according to the invention.
Figure 4:
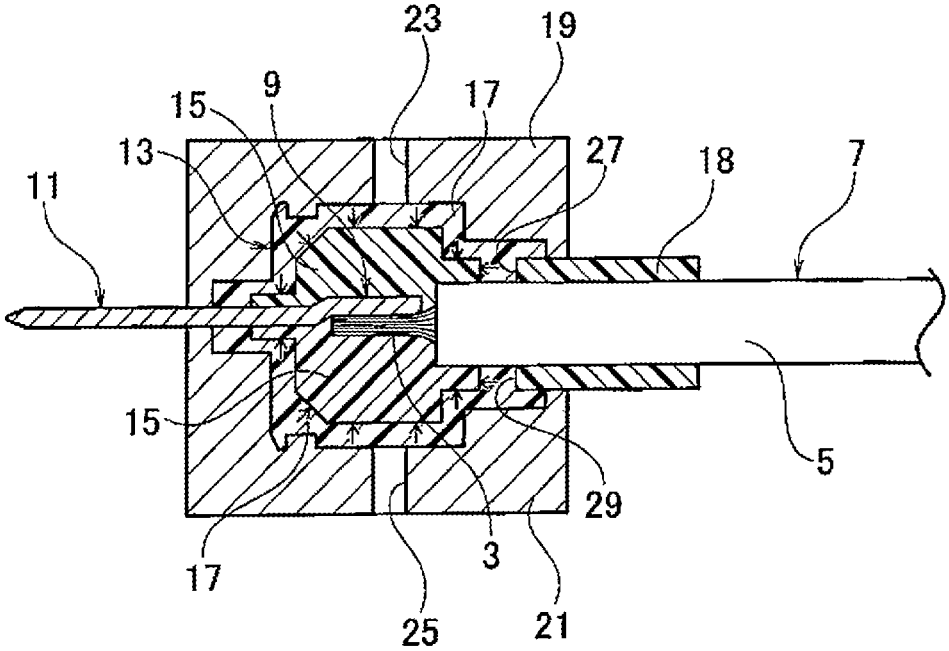
FIG. 4 is a view showing the process for integrally molding the connector in the embodiment according to the invention.

Referring to FIGS. 1 to 4, the connector in the embodiment according to the invention and the method of integrally molding the connector will be described.

A connector 1 in this embodiment includes an electric wire 7 of which a core part 3 is covered with a cover part 5, a terminal 11 having a connection part 9 which is connected to the core part 3 of the electric wire 7, and a covering member 13 which is provided around the connection part 9. Moreover, the covering member 13 includes elastic resin 15 which is provided around the connection part 9 and an end part of the cover part 5 positioned adjacent to the connection part 9, to be bonded to the cover part 5, and at the same time, press-fitted to the terminal 11, and resin 17 which is provided around the elastic resin 15 so as to compress the elastic resin 15, and bonded to the elastic resin 15.

This method of integrally molding the connector 1 includes a first step of injection molding the elastic resin 15 around the connection part 9 and the end part of the cover part 5 positioned adjacent to the connection part 9, thereby to bond the cover part 5 and the elastic resin 15 to each other, and a second step of injection molding, after the first step, the resin 17 around the elastic resin 15 so as to press the elastic resin 15 inward (in short, so as to compress the elastic resin 15), thereby to allow the elastic resin 15 to be press-fitted to the terminal 11, and at the same time, to bond the elastic resin 15 and the resin 17 to each other.

Moreover, in the second step, the resin 17 is injection molded around a region positioned adjacent to the connection part 9, out of the elastic resin 15, while a region positioned adjacent to the cover part 5, out of the elastic resin 15, is exposed.

It is to be noted that "bonding" means that two faces in contact with each other adhere to each other, and are made integral. On the other hand, "press-fitting" means that two parts in contact with each other are brought into tight contact by applying an external force, and can be separated, when the external force is removed.

As shown in FIGS. 1 to 4, the connector 1 includes the electric wire 7, the terminal 11, and the covering member 13. The electric wire 7 includes the core part 3 and the cover part 5, and the core part 3 is covered with the cover part 5. One of both end parts of the electric wire 7 is electrically connected to an electric appliance or the like, and at the other end side, the cover part 5 is peeled off thereby to expose a part of the core part 3. The connection part 9 of the terminal 11 is connected to this exposed part of the core part 3.

The terminal 11 is formed of metal such as copper, aluminum in a shape of a thin plate, and electrically connected to the electric wire 7 by caulking the exposed part of the core part 3 with the connection part 9. This terminal 11 is electrically connected to a counterpart terminal (not shown) which is electrically connected to another electric appliance or another electric wire. The covering member 13 is provided around the connection part 9 of the terminal 11 as described above.

The covering member 13 includes the elastic resin 15 and the resin 17. The elastic resin 15 is formed of material such as ester, styrene, olefin, urethane, elastomer of polyamide group, which adheres to the cover part 5 of the electric wire 7 formed of resin, but does not adhere to the terminal 11 formed of metal, and the elastic resin 15 has elasticity. A region of this elastic resin 15 opposed to the cover part 5 of the electric wire 7 is bonded to the cover part 5, and hence, the electric wire 7 is sealed. As the results, it is possible to prevent water or oil from passing through a gap between the elastic resin 15 and the cover part 5, and intruding into the connector 1 from the electric wire 7. Moreover, a region of this elastic resin 15 opposed to the terminal 11 is not bonded to the terminal 11, but kept compressed with the resin 17 which is provided around the elastic resin 15 and hardened. Because of repulsive elasticity of the elastic resin 15 which is forced to be deformed into a small size by the hardened resin 17, a gap between the elastic resin 15 and the terminal 11 is filled, and the elastic resin 15 is press-fitted to the terminal 11. In this manner, the terminal 11 is sealed, and it is possible to prevent water or oil from passing through the gap between the elastic resin 15 and the terminal 11, and intruding into the connector 1 from the terminal 11.

The resin 17 is formed of material such as SPS, PBT which is generally used in the connector, and adheres to the elastic resin 15 but does not adhere to the terminal 11 formed of metal. This resin 17 is injection molded so as to push the elastic resin 15 inward in such a manner that outer faces of the elastic resin 15 may be compressed into an interior of the relevant elastic resin 15. On this occasion, the resin 17 and the elastic resin 15 are bonded to each other thereby to seal a gap between the resin and the elastic resin 15. At the same time, the elastic resin 15 in a compressed state is press-fitted to the terminal 11 with an injection pressure at a time when the resin 17 is molded, and the resin 17 is hardened in this state. In this manner, the elastic resin 15 is press-fitted to the terminal 11 with repulsive elasticity of the elastic resin 15 inside the resin 17 which has been hardened, and thus, the terminal 11 is sealed.

As described above, the electric wire 7 of the connector 1 is sealed by bonding the elastic resin 15 to the cover part 5 of the electric wire 7. On the other hand, at a side of the terminal 11 of the connector 1, the elastic resin 15 is compressed with the injection pressure when the resin 17 is molded, and the elastic resin 15 is press-fitted to the terminal 11 with the repulsive elasticity of the elastic resin 15 inside the resin 17 which has been hardened, and thus, the terminal 11 is sealed. Moreover, the gap between the elastic resin 15 and the resin 17 is sealed by mutual bonding. Therefore, the gap into which water or oil may intrude is eliminated, and the interior of the connector 1 can be completely sealed.

Herein, the method of integrally molding the connector 1 will be described.

At the beginning, by employing a mold (not shown), the elastic resin 15 is injection molded to the connection part 9 of the terminal 11 which caulks the exposed core part 3 of the electric wire 7, and a region near the end part of the cover part 5 of the electric wire 7 which is positioned adjacent to the connection part, thereby to cover the connection part 9 with the elastic resin 15, and to bond the end part of the cover part 5 and the elastic resin 15 to each other. On this occasion, the elastic resin 15 is bonded to the cover part 5, but is not bonded to the terminal 11 (a first step).

Then, a product after the first step has finished is set in molds 19 and 21, and material for the resin 17 is injected from holes 23 and 25 of the molds 19, 21 thereby to injection mold the resin 17 around the elastic resin 15 so as to press the elastic resin 15 inward (in short, so as to compress the elastic resin 15). On this occasion, the elastic resin 15 is collapsed to interiors of the molds 19, 21 with the injection pressure of the resin 17, as shown by arrow marks. At the same time, a region where the elastic resin 15 and the resin 17 are in contact with each other is bonded, and the resin 17 intrudes from holes 27 and 29 which are provided in the elastic resin 15 thereby to bring the elastic resin 15 and the resin 17 into an integrated state (a second step).

In this second step, the resin 17 is injection molded to a region positioned adjacent to the connection part 9, out of the elastic resin 15 which has been injection molded around the connection part 9, and a region positioned adjacent to the cover part 5, out of the elastic resin 15, is exposed. By injection molding the resin 17 in this manner, a drawing part of the electric wire 7 where an exposed part 18 is present is made flexible due to elasticity of the elastic resin 15, while rigidity of the drawing part is maintained by being covered with the elastic resin 15. As the results, it is possible to dispose the connector 1 even in such a narrow place that a drawing position of the electric wire 7 is limited.

In the connector 1 which has been integrally molded in the above described steps, there is no gap into which water or oil can intrude, and the interior of the connector 1 where the connection part 9 is positioned is completely sealed.

In the method of integrally molding the connector 1 as described above, the elastic resin 15 is bonded to the cover part 5, and the elastic resin 15 is bonded to the resin 17 and press-fitted to the terminal 11. Therefore, the elastic resin 15 and the resin 17 do not adhere to the metal molds which are used in the first and second steps, and the mold releasing performance can be enhanced. As the results, it is possible to restrain bad influences such as deterioration of productivity, change in shape, and to achieve mass production.

Moreover, in the second step, the resin 17 is injection molded around the elastic resin 15 so as to compress the outer faces of the elastic resin 15 into the interior. Consequently, the elastic resin 15 is press-fitted to the terminal 11 with the repulsive elasticity of the elastic resin 15 inside the resin 17 which has been hardened, and the gap between the elastic resin 15 and the terminal 11 is sealed. As the results, the terminal side of the electric wire 7 is sealed, and there is no necessity of using other members for waterproofing the connector 1, and the number of components and assembling steps can be reduced.

Accordingly, it is possible to reduce the number of the components, and to enhance productivity.

Moreover, in the second step, the resin 17 is injection molded around the region positioned adjacent to the connection part 9, out of the elastic resin 15 which has been injection molded around the connection part 9, and the region positioned adjacent to the cover part 5, out of the elastic resin 15, is exposed. Therefore, the drawing part of the electric wire 7 can be made flexible, while maintaining the rigidity of the drawing part of the electric wire 7, and freeness in arranging the connector 1 can be enhanced.

In the connector in the embodiment according to the invention, by bonding the elastic resin and the resin to each other, the waterproofing performance is enhanced. However, the elastic resin and the resin need not be bonded to each other, provided that the elastic resin and the resin can be brought into tight contact by injection molding the resin.

Although the invention has been descried in detail referring to the specified embodiment, it is apparent to those skilled in the art that various modifications and amendments can be added without deviating from spirit and scope of the invention.

This invention is based on Japanese Patent Application (Application No. 2009-154937) filed on Jun. 30, 2009, the contents of which are hereby incorporated by reference.

Description Of The Reference Numerals

1 Connector
3 Core part
5 Cover part
7 Electric wire
9 Connection part
11 Terminal
13 Covering member
15 Elastic resin
17 Resin

The invention claimed is:

1. A method of integrally molding a connector for integrally molding an electric wire having a core part covered with a cover part, a terminal having a connection part connected to the core part of the electric wire which is exposed by peeling off the cover part, and a covering member provided around the connection part, the method comprising a first step of injection molding elastic resin around the connection part and an end part of the cover part which is positioned adjacent to the connection part thereby to bond the cover part and the elastic resin to each other, and a second step of injection molding resin around the elastic resin so as to compress the elastic resin, and at the same time, bonding the elastic resin and the resin to each other.

2. The method of integrally molding a connector as claimed in claim 1, wherein in the second step, the resin is injection molded around a region positioned adjacent to the connection part, out of the elastic resin, while a region positioned adjacent to the cover part, out of the elastic resin, is exposed.

3. A connector comprising an electric wire having a core part covered with a cover part, a terminal having a connection part connected to the core part of the electric wire which is exposed by peeling off the cover part, and a covering member provided around the connection part, all of which are integrally molded, wherein the covering member includes elastic resin which is provided around the connection part and an end part of the cover part positioned adjacent to the connection part, the elastic resin being bonded to the cover part and at the same time, press-fitted to the terminal, and resin which is provided around the elastic resin so as to compress the elastic resin, and bonded to the elastic resin.

* * * * *